US006657623B1

(12) United States Patent
Shin

(10) Patent No.: US 6,657,623 B1
(45) Date of Patent: Dec. 2, 2003

(54) METHOD AND APPARATUS FOR TRANSMITTING A VIDEO SIGNAL

(75) Inventor: Hyun-kuk Shin, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/532,879

(22) Filed: Mar. 22, 2000

(30) Foreign Application Priority Data

Jul. 13, 1999 (KR) ..... 1999-28202

(51) Int. Cl.[7] ..... G09G 5/00; G09G 1/06

(52) U.S. Cl. ..... 345/213; 345/11; 348/572

(58) Field of Search ..... 348/572, 573, 348/574, 739; 341/146; 345/204, 205, 213, 214, 157, 11, 87; 340/703

(56) References Cited

U.S. PATENT DOCUMENTS

RE33,916 E * 5/1992 Saenz et al. ..... 340/703
5,798,720 A * 8/1998 Yano ..... 341/101
5,949,495 A * 9/1999 Tallman et al. ..... 345/157

OTHER PUBLICATIONS

Digital Display Working Group, "Digital Visual Interface DVI, Revision 1.0", Apr. 2, 1999, pp. 11, 24–27 and 30.*
Silicon Image documents "All–Digital Solutions for All–Digital Displays" and "Hitachi Launches First All–Digital Desktop PC Family in Japan Using Silicon Image's Panel-Link Technology".*

* cited by examiner

*Primary Examiner*—Dennis-Doon Chow
(74) *Attorney, Agent, or Firm*—Robert E. Bushnell, Esq.

(57) ABSTRACT

In a method and apparatus for transmitting a video signal, parallel digital video signals output from a graphic controller of a computer are transmitted to a driver of a cathode ray tube monitor by converting the parallel digital video signals to serial digital video signals, transmitting the converted serial digital video signals to the cathode ray tube monitor via a cable, converting the transmitted serial digital video signals to serial analog video signals, and inputting the converted serial analog video signals to the driver of the cathode ray tube monitor.

22 Claims, 3 Drawing Sheets

METHOD AND APPARATUS FOR TRANSMITTING A VIDEO SIGNAL

CLAIM OF PRIORITY

This application makes reference to, incorporates the same herein, and claims all benefits accruing under 35 U.S.C. §119 from an application entitled METHOD FOR SENDING IMAGE SIGNAL earlier filed in the Korean Industrial Property Office on Jul. 13$^{th}$1999, and there duly assigned Serial No. 99-28202.

BACKGROUND OF THE INVENTION

1. Field of the Invention

The present invention relates to a method and apparatus for transmitting a video signal, and more particularly, to a method and apparatus for transmitting a video signal by processing a video signal from a computer and inputting the processed signal to a cathode ray tube (CRT) monitor.

2. Description of the Related Art

In a typical computer, a graphic controlling unit controls a video random access memory (RAM) according to a control signal, an address signal and a data signal from a central processing unit (CPU) to generate a parallel digital video signal. The parallel digital video signal is converted to an analog video signal and then is transmitted to a cathode ray tube (CRT) monitor.

Referring to FIG. 1, a video card of a conventional computer 100 includes a graphic controller 11, a video random access memory (RAM) 12, a clock pulse generator 13 and a digital-to-analog converter (DAC) 14. The graphic controller 11 reads or writes data from or to an input address (ADR) area of the video random access memory (RAM) 12 by means of a read/write signal (R/W) according to a control signal (CTR) output from the central processing unit (CPU) 10 of the computer 100. The graphic controller 11 and the digital-to-analog converter (DAC) 14 operate according to a clock pulse signal (CLK) output from the clock pulse generator 13.

The graphic controller 11 processes data output from the video random access memory (RAM) 12 to generate a parallel digital red video signal $R_P$, a parallel digital green video signal $G_P$, a parallel digital blue video signal $B_P$, a horizontal sync signal $H_{SYNC}$, a vertical sync signal $V_{SYNC}$ and a data enable signal DE.

The digital-to-analog converter (DAC) 14 processes the parallel digital signals output from the graphic controller 11 to generate an analog red video signal $R_A$, an analog green video signal $G_A$, an analog blue video signal $B_A$, and an analog synthesized sync signal $SYNC_A$. The analog signals output from the digital-to-analog converter (DAC) 14 are transmitted to a monitor 110 via a metal cable 15.

An amplifier 16 of the monitor 110 amplifies the received analog video signals $R_A$, $G_A$, and $B_A$ and inputs the amplified signals $R_A$, $G_A$, and $B_A$ to a cathode ray tube (CRT) driver 18 of monitor 110. Also, a synchronization controller 17 of monitor 110 controls the received analog synthesized sync signal $SYNC_A$ to input this controlled signal to the cathode ray tube (CRT) driver 18.

According to the conventional transmission method, the parallel digital video signals are transmitted as converted analog signals. Thus, noise externally generated affects the transmission of the analog signals so that the video signals are easily distorted during the transmission period.

SUMMARY OF THE INVENTION

To solve the above problem, it is an objective of the present invention to provide a method and apparatus for transmitting a video signal from a computer to a cathode ray tube monitor by processing the video signal so that the rate of distortion of the transmitted video signal can be reduced.

Accordingly, to achieve the above objective and other objectives of the present invention, there is provided a method of and apparatus for transmitting parallel digital video signals output from a graphic controller of a computer to a driver of a cathode ray tube monitor, transmission being achieved by converting the parallel digital video signals to serial digital video signals, transmitting the converted serial digital video signals to the cathode ray tube monitor via a cable, converting the transmitted serial digital video signals to serial analog video signals, and inputting the converted serial analog video signals to the driver of the cathode ray tube monitor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicated the same or similar components, wherein.

DETAILED DESCRIPTION OF THE PREFERRED EMBODIMENTS

Figure 1:
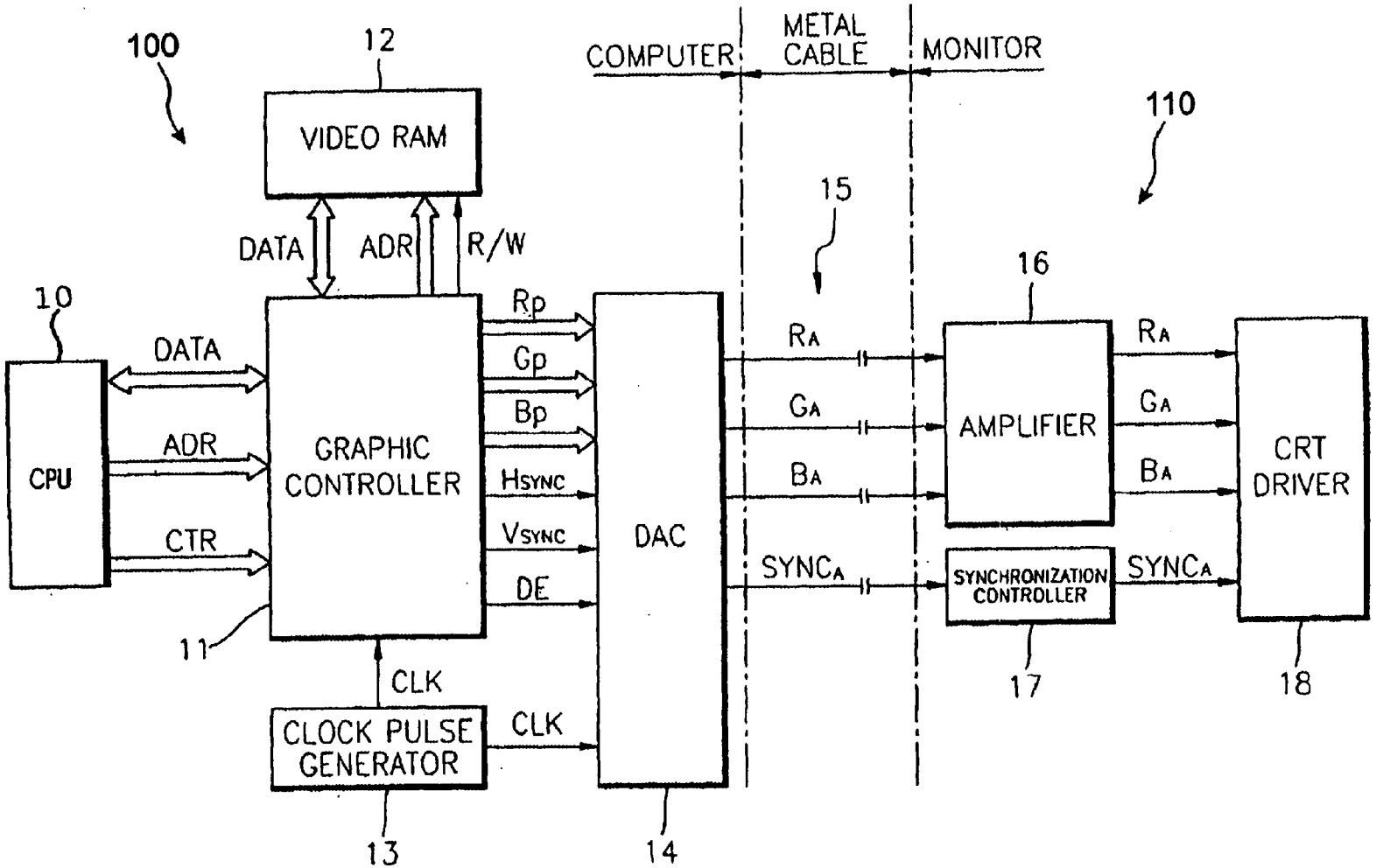
FIG. 1 (PRIOR ART)
FIG. 1 is a block diagram showing a conventional method of transmitting video signals.
Figure 2:
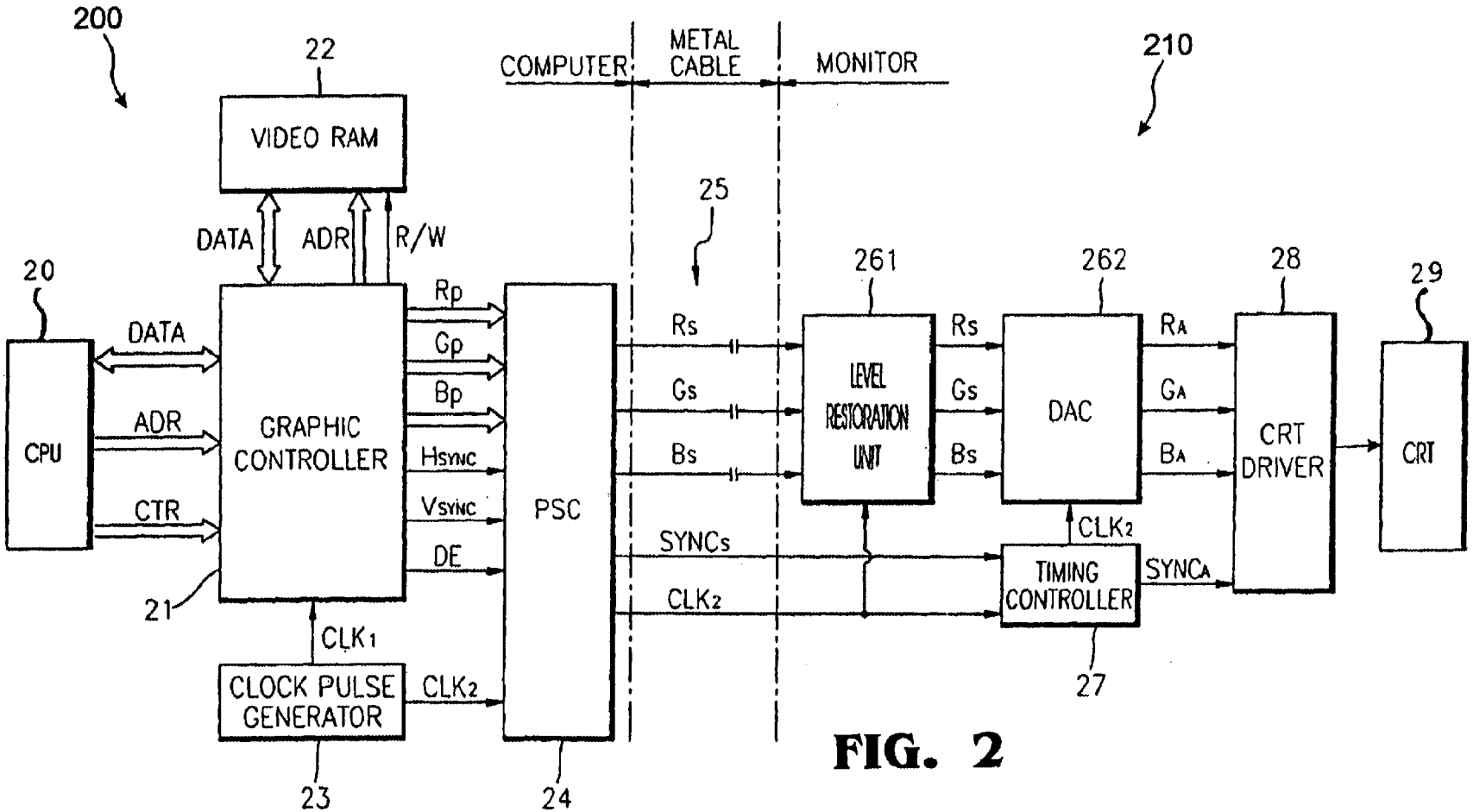
FIG. 2 is a block diagram showing a method of and apparatus for transmitting video signals according to an embodiment of the present invention.

Referring to FIG. 2, a video card of a computer 200 according to an embodiment of the present invention includes a graphic controller 21, a video random access memory (RAM) 22, a clock pulse generator 23 and a parallel-to-serial converter (PSC) 24. The graphic controller 21 reads or writes data (DATA) from or to an input address (ADR) area of the video random access memory (RAM) 22 by means of a read/write signal (R/W) and according to a control signal (CTR) output from the central processing unit (CPU) 20 of the computer 200.

The graphic controller 21 of computer 200 processes data (DATA) output from the video random access memory (RAM) 22 to generate an n-bit (for example, an 8-bit) parallel digital red video signal $R_P$, an n-bit (for example, an 8-bit) parallel digital green video signal $G_P$, an n-bit (for example, an 8-bit) parallel digital blue video signal $B_P$, a horizontal sync signal $H_{SYNC}$, a vertical sync signal $V_{SYNC}$ and a data enable signal DE, as parallel digital video signals. The graphic controller 21 operates according to a first clock pulse signal $CLK_1$output from the clock pulse generator 23. The parallel-to-serial converter (PSC) 24 operates according to a second clock pulse signal $CLK_2$ output from the clock pulse generator 23. Preferably, the frequency of the second clock pulse signal $CLK_2$ is n-times (for example, 8 times) that of the first clock pulse signal $CLK_1$.

The parallel-to-serial converter (PSC) 24 processes the input parallel digital signals $R_P$, $G_P$, $B_P$, $H_{SYNC}$ and $V_{SYNC}$ from graphic controller 21 to generate a serial digital red video signal $R_S$, a serial digital green video signal $G_S$, a serial digital blue video signal $B_S$, a digital synthesized sync signal $SYNC_S$ and a second clock pulse signal $CLK_2$ as serial digital video signals, for example. The digital synthesized sync signal $SYNC_S$ is generated according to the horizontal sync signal $H_{SYNC}$, the vertical sync signal $V_{SYNC}$ and the data enable signal DE from the graphic controller 21. The serial digital signals output from the parallel-to-serial converter (PSC) 24 are transmitted to a cathode ray tube (CRT) monitor 210 via a metal cable 25.

Continuing with reference to FIG. 2, a level restoration unit 261 in the cathode ray tube (CRT) monitor 210 operates according to the received second clock pulse signal $CLK_2$ and restores the direct current of the serial digital red video signal $R_S$, the serial digital green video signal $G_S$, and the serial digital blue video signal $B_S$ to the original state before the transmission. A timing controller 27 of monitor 210, operating according to the received second clock pulse signal $CLK_2$, converts the digital synthesized sync signal $SYNC_S$ from the parallel-to-serial converter (PSC) 24 to an analog synthesized sync signal $SYNC_A$, and controls timing of the second clock pulse signal $CLK_2$ to input the controlled signal $CLK_2'$ to a digital-to-analog converter (DAC) 262 of monitor 210.

A cathode ray tube (CRT) driver 28 of monitor 210 drives the cathode ray tube (CRT) 29 of monitor 210 according to serial analog video signals $R_A$, $G_A$, and $B_A$ output from the digital-to-analog converter (DAC) 262 and an analog synthesized sync signal $SYNC_A$ output from the timing controller 27, and displays a corresponding image on the cathode ray tube (CRT) 29. The digital-to-analog converter 262 desirably generates serial analog red video signals (Re) according to the value of the serial digital red video signal of an n-bit packet which is input to the digital-to-analog converter 262 while n pulses of the second clock pulse signal are input to the digital-to-analog converter 262. The digital-to-analog converter 262 also desirably simultaneously generates serial analog green video signals ($G_A$) according to the value of the serial digital green video signal of an n-bit packet which is input to the digital-to-analog converter 262 while n pulses of the second clock pulse signal are input to the digital-to-analog converter 262. Further, the digital-to-analog converter 262 also desirably simultaneously generates serial analog blue video signals ($B_A$) according to the value of the serial digital blue video signal of an n-bit packet which is input to the digital-to-analog converter 262 while n pulses of the second clock pulse signal are input to the digital-to-analog converter 262. The digital-to-analog converter 262 repeats the generation of the serial analog red, green and blue video signals ($R_A$,$G_A$, $B_A$), as necessary, for displaying a corresponding image on the cathode ray tube (CRT) 29.

Figure 3:
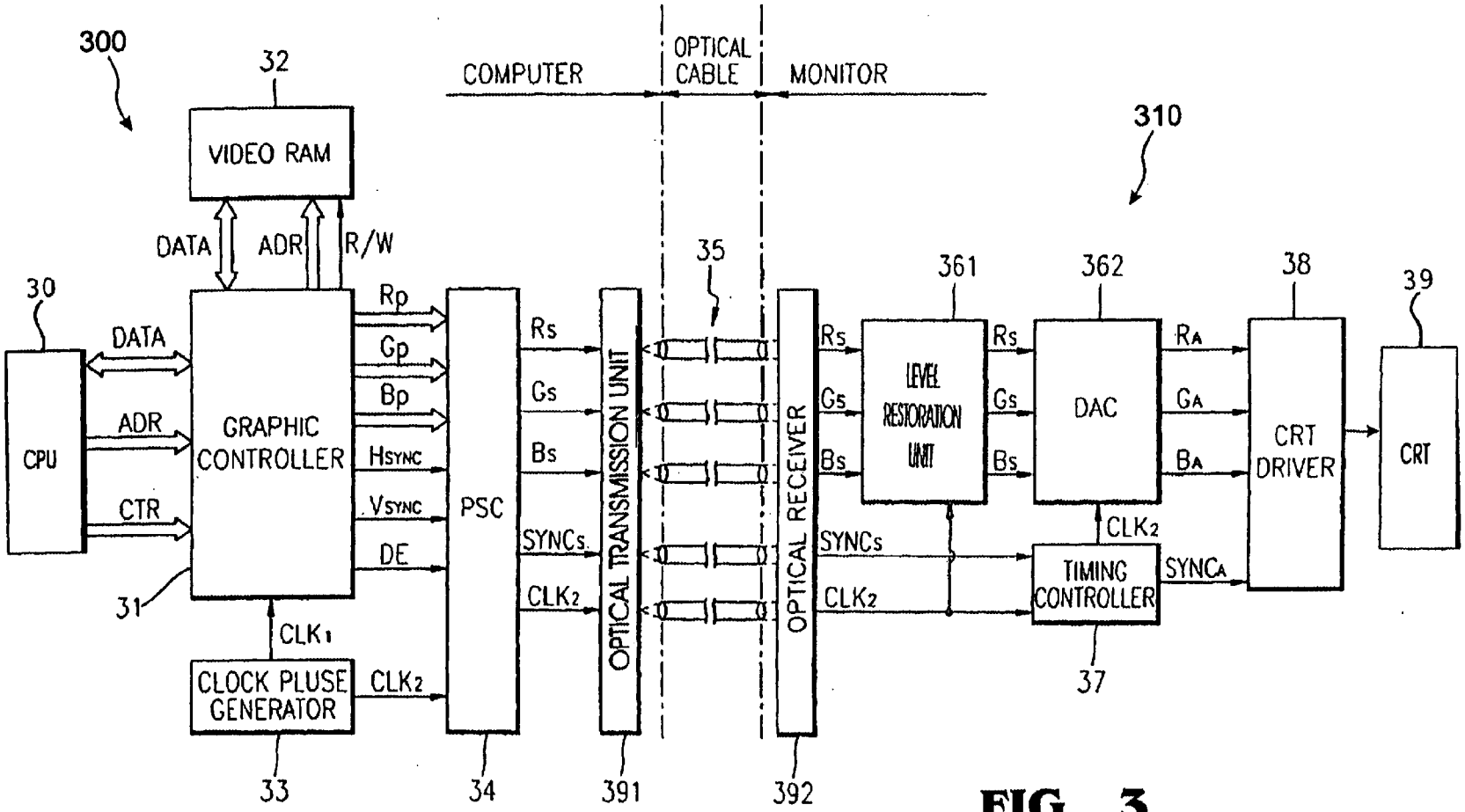
FIG. 3 is a block diagram showing a method of and apparatus for transmitting video signals according to another embodiment of the present invention.

Referring to FIG. 3, a video card of a computer 300 according to another embodiment of the present invention includes a graphic controller 31, a video random access memory (RAM) 32, a clock pulse generator 33, a parallel-to-serial converter (PSC) 34, and an optical transmission unit 391. In comparison to the structure of FIG. 2, in FIG. 3, the optical transmission unit 391 and an optical receiver 392 are added, and the metal cable 25 is replaced with an optical cable 35. That is, graphic controller 31 of computer 300 has the same function as the graphic controller 21 of computer 200 of FIG. 2; video random access memory (RAM) 32 of computer 300 has the same function as the video random access memory (RAM) 22 of computer 200 of FIG. 2; clock pulse generator 33 of computer 300 has the same function as the clock pulse generator 23 of computer 200 of FIG. 2; parallel-to-serial converter (PSC) 34 of computer 300 has the same function as the parallel-to-serial converter (PSC) 24 of computer 200 of FIG. 2; level restoration unit 361 of monitor 310 has the same function as the level restoration unit 261 of monitor 210 of FIG. 2; digital-to-analog converter (DAC) 362 of monitor 310 has the same function as the digital-to-analog converter (DAC) 262 of monitor 210 of FIG. 2; timing controller 37 of monitor 310 has the same function as the timing controller 27 of monitor 210 of FIG. 2; and cathode ray tube (CRT) driver 38 of monitor 310 has the same function as the cathode ray tube (CRT) driver 28 of monitor of FIG. 2.

In this regard, referring to FIG. 3, the graphic controller 31 reads or writes data (DATA) from or to an input address (ADR) area of the video random access memory (RAM) 32 by means of a read/write signal (R/W) according to a control signal (CTR) output from the central processing unit (CPU) 30 of the computer 300. The graphic controller 31 of computer 300 processes data (DATA) output from the video random access memory (RAM) 32 to generate an n-bit (for example, an 8-bit) parallel digital red video signal $R_P$, an n-bit (for example, an 8-bit) parallel digital green video signal $G_P$, an n-bit (for example, an 8-bit) parallel digital blue video signal $B_P$, a horizontal sync signal $H_{SYNC}$, a vertical sync signal $V_{SYNC}$, and a data enable signal DE as parallel digital video signals. The graphic controller 31 operates according to a first clock pulse signal $CLK_1$ output from the clock pulse generator 33. The parallel-to-serial converter (PSC) 34 operates according to a second clock pulse signal $CLK_2$ output from the clock pulse generator 33. The frequency of the second clock pulse signal $CLK_2$ is n-times (for example, 8 times) that of the first clock pulse signal $CLK_1$.

The parallel-to-serial converter (PSC) 34 processes the input parallel digital signals $R_P$, $G_P$, and $B_P$, from graphic controller 31 to generate a serial digital red video signal $R_S$, a serial digital green video signal $G_S$, a serial digital blue video signal $B_S$, a digital synthesized sync signal $SYNC_S$ and a second clock pulse signal $CLK_2$ as serial digital video signals. The digital synthesized sync signal $SYNC_S$ is generated according to the horizontal sync signal $H_{SYNC}$, the vertical sync signal $V_{SYNC}$ and the data enable signal DE from the graphic controller 31. The serial digital signals output from the parallel-to-serial converter (PSC) 34 are transmitted to an optical transmission unit 391.

Continuing with reference to FIG. 3, the optical transmission unit 391 of computer 300 converts the serial digital signals $R_S$, $G_S$, $B_S$, $SYNC_S$ and $CLK_2$ output from parallel-to-serial converter (PSC) 34 to respective converted optical signals. These converted optical signals are transmitted to an optical receiver 392 of monitor 310 via the optical cable 35. The optical receiver 392 of monitor 310 converts the received optical signals to electrical serial digital signals $R_S$, $G_S$, $B_S$, $SYNC_S$ and $CLK_2$ providing the signals $R_S$, $G_S$, and $B_S$ to the level restoration unit 361 and providing the signals $SYNC_S$ and $CLK_2$ to timing controller 37 of monitor 310.

Continuing with reference to FIG. 3, the level restoration unit 361 in the cathode ray tube (CRT) monitor 310 operates according to the received second clock pulse signal $CLK_2$ and restores the direct current of the serial digital red video signal $R_S$, the serial digital green video signal $G_S$, and the serial digital blue video signal $B_S$, to the original state before the transmission. The timing controller 37 of monitor 310, operating according to the received second clock pulse signal $CLK_2$, converts the digital synthesized sync signal $SYNC_S$ from the optical receiver 392 to the analog synthesized sync signal $SYNC_A$ and controls timing of the second clock pulse signal $CLK_2$ to input the controlled signal $CLK_2$ to a digital-to-analog converter (DAC) 362 of monitor 310.

A cathode ray tube (CRT) driver 38 of monitor 310 drives the cathode ray tube (CRT) 39 of monitor 310 according to serial analog video signals $R_A$, $G_A$, and $B_A$ output from the digital-to-analog converter (DAC) 362 and an analog synthesized sync signal $SYNC_A$ output from the timing controller 37, and displays a corresponding image on the cathode ray tube (CRT) 39. The digital-to-analog converter 362 desirably generates serial analog red video signals ($R_A$) according to the value of the serial digital red video signal of an n-bit packet which is input to the digital-to-analog converter 362 while n pulses of the second clock pulse signal are input to the digital-to-analog converter 362. The digital-to-analog converter 362 also desirably simultaneously generates serial analog green video signals ($G_A$) according to the value of the serial digital green video signal of an n-bit packet which is input to the digital-to-analog converter 362 while n pulses of the second clock pulse signal are input to the digital-to-analog converter 362. Further, the digital-to-analog converter 362 also desirably simultaneously generates serial analog blue video signals ($B_A$) according to the value of the serial digital blue video signal of an n-bit packet which is input to the digital-to-analog converter 362 while n pulses of the second clock pulse signal are input to the digital-to-analog converter 362. The digital-to-analog converter 362 repeats the generation of the serial analog red, green and blue video signals ($R_A$, $G_A$, $B_A$), as necessary, for displaying a corresponding image on the cathode ray tube (CRT) 39.

The above optical transmission method and apparatus of FIG. 3 is desirable and effective in a case in which transmitting the serial digital data causes the rate of distortion of a signal to increase significantly, such as can occur when an analog transmission method is performed. Also, an optical transmission method, such as that illustrated in FIG. 3, typically becomes more efficient when the distance between the computer and the cathode ray tube (CRT) monitor (such as between computer 300 and monitor 310) increases.

As described above, in the method of and apparatus for transmitting a video signal according to the present invention, as the parallel digital video signals are transmitted by being converted to serial digital video signals, the signals transmitted are not easily affected by noise generated externally during the transmission period. Thus, the rate of distortion of the transmitted video signals can be advantageously reduced. Also, in the present invention, at the stage of inputting the transmitted video signals to the driver of the monitor, analog video signals can be directly generated by the digital-to-analog converter without restoring a serial digital video signal from a parallel digital video signal. Thus, the circuit for input to the driver of the monitor in the present invention can be advantageously simplified.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention include all embodiments falling within the scope of the appended claims.

What is claimed is:

1. A method of transmitting parallel digital video signals output from a graphic controller of a computer to a driver of a cathode ray tube monitor, comprising the steps of:

converting the parallel digital video signals to serial digital video signals;

transmitting the serial digital video signals to the cathode ray tube monitor;

converting the transmitted serial digital video signals to serial analog video signals; and inputting the serial analog video signals to the driver of the cathode ray tube monitor;

wherein the parallel digital video signals comprise an n-bit parallel digital red video signal, an n-bit parallel digital green video signal, an n-bit parallel digital blue video signal, a vertical sync signal, a horizontal sync signal and a data enable signal; and wherein the graphic controller operates according to a first clock pulse signal, and said converting of the parallel digital video signals to the serial digital video signals is performed according to a second clock pulse signal having a frequency n times a frequency of the first clock pulse signal, wherein said step of converting the transmitted serial digital video signals to serial analog video signals comprises the steps of:

generating serial analog red video signals according to a value of a serial digital red video signal of an n-bit packet according to n pulses of the second clock pulse signal;

simultaneously, while performing said step of generating serial analog red video signals, generating serial analog green video signals according to a value of a serial digital green video signal of an n-bit packet according to n pulses of the second clock pulse signal;

simultaneously, while performing said step of generating serial analog red video signals, generating serial analog blue video signals according to a value of a serial digital blue video signal of an n-bit packet according to n pulses of the second clock pulse signal; and repeating simultaneously said steps of generating serial analog red video signals, generating serial analog green video signals and generating serial analog blue video signals until the serial analog red video signals, the serial analog green video signals and the serial analog blue video signals for a corresponding image have been generated.

2. The method of claim 1, wherein the serial digital video signals comprise a serial digital red video signal, a serial digital green video signal, a serial digital blue video signal, a synthesized sync signal and the second clock pulse signal, and said method further comprises generating the synthesized sync signal according to the vertical sync signal, the horizontal sync signal and the data enable signal.

3. The method of claim 2, wherein said step of transmitting the serial digital video signals comprises the steps of:

converting the serial digital video signals to optical signals;

transmitting the optical signals to the cathode ray tube monitor via an optical cable; and restoring the transmitted optical signals to the serial digital video signals.

4. The method of claim 1, wherein said step of transmitting the serial digital video signals comprises the steps of:

converting the serial digital video signals to optical signals;

transmitting the optical signals to the cathode ray tube monitor via an optical cable; and restoring the transmitted optical signals to the serial digital video signals.

5. The method of claim 4, wherein "n" is equal to 8.

6. The method of claim 1, wherein "n" is equal to 8.

7. The method of claim 1, wherein said serial digital video signals are transmitted to the cathode ray tube monitor via a metal cable.

8. A method of transmitting parallel digital video signals from a graphic controller of a computer to a cathode ray tube monitor, comprising the steps of:

converting the parallel digital video signals by means of a parallel-to-serial converter to serial digital video signals;

transmitting the serial digital video signals from the parallel-to-serial converter to the cathode ray tube monitor;

converting the transmitted serial digital video signals to serial analog video signals; and inputting the serial analog video signals to a driver of the cathode ray tube monitor;

wherein the parallel digital video signals comprise an n-bit parallel digital red video signal, an n-bit parallel digital green video signal, an n-bit parallel digital blue video signal, a vertical sync signal, a horizontal sync signal and a data enable signal; and wherein the graphic controller operates according to a first clock pulse signal, and said converting of the parallel digital video signals to the serial digital video signals is performed according to a second clock pulse signal having a frequency n times a frequency of the first clock pulse signal, wherein the serial digital video signals comprise a serial digital red video signal, a serial digital green video signal, a serial digital blue video signal, a synthesized sync signal and the second clock pulse signal, and said method further comprises generating the synthesized sync signal according to the vertical sync signal, the horizontal sync signal and the data enable signal, and wherein said step of converting the transmitted serial digital video signals to serial analog video signals comprises the steps of:

generating serial analog red video signals according to a value of the serial digital red video signal of an n-bit packet according to n pulses of the second clock pulse signal;

simultaneously, while performing said step of generating serial analog red video signals, generating serial analog green video signals according to a value of the serial digital green video signal of an n-bit packet according to n pulses of the second clock pulse signal;

simultaneously, while performing said step of generating serial analog red video signals, generating serial analog blue video signals according to a value of the serial digital blue video signal of an n-bit packet according n pulses of the second clock pulse signal; and repeating simultaneously said steps of generating serial analog red video signals, generating serial analog green video signals and generating serial analog blue video signals until the serial analog red video signals, the serial analog green video signals and the serial analog blue video signals for a corresponding image have been generated.

9. The method of claim 8, wherein said step of transmitting serial digital video signals comprises the steps of:

converting the serial digital video signals to optical signals;

transmitting the optical signals to the cathode ray tube monitor via an optical cable; and restoring the transmitted optical signals to the serial digital video signals.

10. The method of claim 8, wherein "n" is equal to 8.

11. The method of claim 8, wherein said serial digital video signals are transmitted to the cathode ray tube monitor via a metal cable.

12. An apparatus for transmitting parallel digital video signals from a computer to a cathode ray tube monitor, comprising:

means for converting the parallel digital video signals to serial digital video signals;

means for transmitting the serial digital video signals to the cathode ray tube monitor;

means for converting the transmitted serial digital video signals to serial analog video signals; and means for inputting the serial analog video signals to a driver of the cathode ray tube monitor;

wherein said means for converting the parallel digital video signals to serial digital video signals performs functions of:

generating serial analog red video signals according to a value of a serial digital red video signal of an n-bit packet according to n pulses of the second clock pulse signal;

simultaneously, while generating the serial analog red video signals, generating serial analog green video signals according to a value of a serial digital green video signal of an n-bit packet according to n pulses of the second clock pulse signal;

simultaneously, while generating the serial analog red video signals, generating serial analog blue video signals according to a value of a serial digital blue video signal of an n-bit packet according to n pulses of the second clock pulse signal; and repeating simultaneously said steps of generating serial analog red video signals, generating serial analog green video signals and generating serial analog blue video signals until the serial analog red video signals, the serial analog green video signals and the serial analog blue video signals for a corresponding image have been generated.

13. A method of transmitting parallel digital video signals output from a graphic controller of a computer to a driver of a cathode ray tube monitor, comprising the steps of:

converting the parallel digital video signals to serial digital video signals;

transmitting the serial digital video signals to the cathode ray tube monitor;

converting the transmitted serial digital video signals to serial analog video signals; and inputting the serial analog video signals to the driver of the cathode ray tube monitor;

wherein the graphic controller operates according to a first clock pulse signal, and said converting of the parallel digital video signals to the serial digital video signals is performed according to a second clock pulse signal having a frequency n times a frequency of the first clock pulse signal, wherein the serial digital video signals comprise a serial digital red video signal, a serial digital green video signal, a serial digital blue video signal, a synthesized sync signal and the second clock pulse signal, and said method further comprises generating the synthesized sync signal according to a vertical sync signal, a horizontal sync signal and a data enable signal, and wherein said step of converting the transmitted serial digital video signals to serial analog video signals comprises the steps of:

generating serial analog red video signals according to a value of a serial digital red video signal of an n-bit packet according to n pulses of the second clock pulse signal;

simultaneously, while performing said step of generating serial analog red video signals, generating serial analog green video signals according to a value of a serial digital green video signal of an n-bit packet according to n pulses of the second clock pulse signal;

simultaneously, while performing said step of generating serial analog red video signals, generating serial analog blue video signals according to a value of a serial digital blue video signal of an n-bit packet according to n pulses of the second clock pulse signal; and repeating simultaneously said steps of generating serial analog red video signals, generating serial analog green video signals and generating serial analog blue video signals until the serial analog red video signals, the serial analog green video signals and the serial analog blue video signals for a corresponding image have been generated.

14. The method of claim 13, wherein "n" is equal to 8.

15. A method of transmitting parallel digital video signals from a graphic controller of a computer to a cathode ray tube monitor, comprising the steps of:

converting the parallel digital video signals by means of a parallel-to-serial converter to serial digital video signals;

transmitting the serial digital video signals from the parallel-to-serial converter to the cathode ray tube monitor;

converting the transmitted serial digital video signals to serial analog video signals; and inputting the serial analog video signals to a driver of the cathode ray tube monitor;

wherein the graphic controller operates according to a first clock pulse signal, and said converting of the parallel digital video signals to the serial digital video signals is performed according to a second clock pulse signal having a frequency n times a frequency of the first clock pulse signal, wherein the serial digital video signals comprise a serial digital red video signal, a serial digital green video signal, a serial digital blue video signal, a synthesized sync signal and the second clock pulse signal, and said method further comprises generating the synthesized sync signal according to a vertical sync signal, a horizontal sync signal and a data enable signal, and, wherein said step of converting the transmitted serial digital video signals to serial analog video signals comprises the steps of:

generating serial analog red video signals according to a value of the serial digital red video signal of an n-bit packet according to n pulses of the second clock pulse signal;

simultaneously, while performing said step of generating serial analog red video signals, generating serial analog green video signals according to a value of the serial digital green video signal of an n-bit packet according to n pulses of the second clock pulse signal;

simultaneously, while performing said step of generating serial analog red video signals, generating serial analog blue video signals according to a value of the serial digital blue video signal of an n-bit packet according n pulses of the second clock pulse signal; and repeating simultaneously said steps of generating serial analog red video signals, generating serial analog green video signals and generating serial analog blue video signals until the serial analog red video signals, the serial analog green video signals and the serial analog blue video signals for a corresponding image have been generated.

16. The method of claim 15, wherein "n" is equal to 8.

17. A method of transmitting parallel digital video signals from a graphic controller of a computer to a cathode ray tube monitor, comprising the steps of:

converting the parallel digital video signals by means of a parallel-to-serial converter to serial digital video signals;

transmitting the serial digital video signals from the parallel-to-serial converter to the cathode ray tube monitor;

converting the transmitted serial digital video signals to serial analog video signals; and inputting the serial analog video signals to a driver of the cathode ray tube monitor;

wherein the parallel digital video signals comprise an n-bit parallel digital red video signal, an n-bit parallel digital green video signal, an n-bit parallel digital blue video signal, a vertical sync signal, a horizontal sync signal and a data enable signal; and wherein the graphic controller operates according to a first clock pulse signal, and said converting of the parallel digital video signals to the serial digital video signals is performed according to a second clock pulse signal having a frequency n times a frequency of the first clock pulse signal, wherein said step of converting the transmitted serial digital video signals to serial analog video signals comprises the steps of:

generating serial analog red video signals according to a value of a serial digital red video signal of an n-bit packet according to n pulses of the second clock pulse signal;

simultaneously, while performing said step of generating serial analog red video signals, generating serial analog green video signals according to a value of a serial digital green video signal of an n-bit packet according to n pulses of the second clock pulse signal;

simultaneously, while performing said step of generating serial analog red video signals, generating serial analog blue video signals according to a value of a serial digital blue video signal of an n-bit packet according to n pulses of the second clock pulse signal; and repeating simultaneously said steps of generating serial analog red video signals, generating serial analog green video signals and generating serial analog blue video signals until the serial analog red video signals, the serial analog green video signals and the serial analog blue video signals for a corresponding image have been generated.

18. A method of transmitting parallel digital video signals from a graphic controller of a computer to a cathode ray tube monitor, comprising the steps of:

converting the parallel digital video signals by means of a parallel-to-serial converter to serial digital video signals;

transmitting the serial digital video signals from the parallel-to-serial converter to the cathode ray tube monitor;

converting the transmitted serial digital video signals to serial analog video signals; and inputting the serial analog video signals to a driver of the cathode ray tube monitor;

wherein the graphic controller operates according to a first clock pulse signal, and said converting of the parallel digital video signals to the serial digital video signals is performed according to a second clock pulse signal having a frequency n times a frequency of the first clock pulse signal, wherein said step of converting the transmitted serial digital video signals to serial analog video signals comprises the steps of:

generating serial analog red video signals according to a value of a serial digital red video signal of an n-bit packet according to n pulses of the second clock pulse signal;

simultaneously, while performing said step of generating serial analog red video signals, generating serial analog green video signals according to a value of a serial digital green video signal of an n-bit packet according to n pulses of the second clock pulse signal;

simultaneously, while performing said step of generating serial analog red video signals, generating serial analog blue video signals according to a value of a serial digital blue video signal of an n-bit packet according to n pulses of the second clock pulse signal; and repeating simultaneously said steps of generating serial analog red video signals, generating serial analog green video signals and generating serial analog blue video signals until the serial analog red video signals, the serial analog green video signals and the serial analog blue video signals for a corresponding image have been generated.

19. A method of transmitting parallel digital video signals output from a computer to a driver of a cathode ray tube monitor, comprising the steps of:

converting the parallel digital video signals to serial digital video signals;

transmitting the serial digital video signals to the cathode ray tube monitor;

converting the transmitted serial digital video signals to serial analog video signals; and inputting the serial analog video signals to the driver of the cathode ray tube monitor;

wherein said step of converting the transmitted serial digital video signals to serial analog video signals comprises the steps of:

generating serial analog red video signals according to a value of a serial digital red video signal of an n-bit packet according to n pulses of a clock pulse signal;

simultaneously, while performing said step of generating the serial analog red video signals, generating serial analog green video signals according to a value of a serial digital green video signal of an n-bit packet according to n pulses of the clock pulse signal;

simultaneously, while performing said step of generating the serial analog red video signals, generating serial analog blue video signals according to a value of a serial digital blue video signal of an n-bit packet according to n pulses of the clock pulse signal; and repeating simultaneously said steps of generating the serial analog red video signals, generating the serial analog green video signals and generating the serial analog blue video signals until the serial analog red video signals, the serial analog green video signals and the serial analog blue video signals for a corresponding image have been generated.

20. The method of claim 19, wherein the parallel digital video signals comprise an n-bit parallel digital red video signal, an n-bit parallel digital green video signal, an n-bit parallel digital blue video signal, a vertical sync signal, a horizontal sync signal and a data enable signal.

21. The method of claim 19, wherein the computer comprises a graphic controller which operates according to a further clock pulse signal, and said converting of the parallel digital video signals to the serial digital video signals is performed according to the further clock pulse signal, the clock pulse signal having a frequency n times a frequency of the further clock pulse signal.

22. The method of claim 19, wherein the serial digital video signals comprise the serial digital red video signal, the serial digital green video signal, the serial digital blue video signal, a synthesized sync signal and the clock pulse signal, and said method further comprises generating the synthesized sync signal according to a vertical sync signal, a horizontal sync signal and a data enable signal.

* * * * *